US012697652B2

(12) United States Patent
Ide et al.

(10) Patent No.: US 12,697,652 B2
(45) Date of Patent: Aug. 4, 2026

(54) FORMING DEVICE AND FORMING METHOD

(71) Applicant: SUMITOMO HEAVY INDUSTRIES, LTD., Tokyo (JP)

(72) Inventors: Akihiro Ide, Niihama (JP); Kimihiro Nogiwa, Niihama (JP); Noboru Itagaki, Niihama (JP); Norieda Ueno, Niihama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 266 days.

(21) Appl. No.: 18/630,979

(22) Filed: Apr. 9, 2024

(65) Prior Publication Data

US 2024/0253103 A1 Aug. 1, 2024

Related U.S. Application Data

(63) Continuation of application No. PCT/JP2022/041040, filed on Nov. 2, 2022.

(30) Foreign Application Priority Data

Nov. 25, 2021 (JP) ..... 2021-191142

(51) Int. Cl.

| | |
|---|---|
| ***B21D 26/047*** | (2011.01) |
| ***B21D 19/08*** | (2006.01) |
| ***B21D 26/033*** | (2011.01) |
| ***B21D 26/035*** | (2011.01) |

(52) U.S. Cl.

CPC ..... *B21D 26/047* (2013.01); *B21D 19/08* (2013.01); *B21D 26/033* (2013.01); *B21D 26/035* (2013.01)

(58) Field of Classification Search

CPC .. B21D 26/035; B21D 26/033; B21D 26/039; B21D 26/047; B21D 19/08

See application file for complete search history.

(56) References Cited

U.S. PATENT DOCUMENTS

| | | | | |
|---|---|---|---|---|
| 2018/0161843 | A1 | 6/2018 | Sumitomo | |
| 2019/0344321 | A1 | 11/2019 | Nogiwa | |
| 2020/0016645 | A1 * | 1/2020 | Nogiwa | B21D 43/26 |

FOREIGN PATENT DOCUMENTS

| | | | | |
|---|---|---|---|---|
| CN | 111 390 007 | B | 12/2020 | |
| DE | 196 02 490 | C2 | 7/2002 | |
| JP | 3 205105 | B2 | 9/2001 | |
| JP | 2009-220141 | A | 10/2009 | |
| JP | 2018001210 | A * | 1/2018 | B21D 26/047 |
| JP | 2019-072741 | A | 5/2019 | |

(Continued)

OTHER PUBLICATIONS

Translation of JP-2018001210.*

(Continued)

*Primary Examiner* — Bobby Yeonjin Kim
(74) *Attorney, Agent, or Firm* — WTA IP Law P.C.

(57) ABSTRACT

A forming device that forms a metal pipe with a flange from a metal pipe material, the forming device includes a forming die that forms the metal pipe; and a restriction member that restricts a deviation of the metal pipe material during forming, in which the restriction member is divided into a plurality of pieces in a longitudinal direction of the metal pipe material during forming.

13 Claims, 8 Drawing Sheets

(56) References Cited

FOREIGN PATENT DOCUMENTS

| | | | | |
|---|---|---|---|---|
| WO | WO-2017034025 A1 * | 3/2017 | ..... | B21D 26/045 |
| WO | WO-2019171868 A1 * | 9/2019 | ..... | B21D 26/047 |

OTHER PUBLICATIONS

Translation of WO-2017034025.*
Translation of WO-2019171868.*
European search report of EP Application No. 22898368.0 Mailed on Feb. 13, 2025.
International Search Report of PCT/JP2022/041040 Mailed on Jan. 24, 2023.

* cited by examiner

FORMING DEVICE AND FORMING METHOD

CROSS-REFERENCE TO RELATED APPLICATIONS

This is a bypass continuation of International PCT Application No. PCT/JP2022/041040, filed on Nov. 2, 2022, which claims priority to Japanese Patent Application No. 2021-191142, filed on Nov. 25, 2021, which are incorporated by reference herein in their entirety.

BACKGROUND

Technical Field

Certain embodiment of the present disclosure relates to a forming device and a forming method.

Description of Related Art

The related art discloses a forming device used for forming a metal pipe. For example, the related art described below discloses a forming device that includes a forming tool including a lower die and an upper die paired with each other, and a fluid supply unit for supplying a fluid into a metal pipe material held between the upper and lower dies.

SUMMARY

According to an aspect of the present disclosure, there is provided a forming device that forms a metal pipe with a flange from a metal pipe material, the forming device including a forming die that forms the metal pipe; and a restriction member that restricts a deviation of the metal pipe material during forming, in which the restriction member is divided into a plurality of pieces in a longitudinal direction of the metal pipe material during forming.

According to another aspect of the present disclosure, there is provided a forming method of forming a metal pipe with a flange from a metal pipe material, the forming method including a step of restricting a deviation of the metal pipe material with a restriction member during forming of the metal pipe, in which in the step, the deviation of the metal pipe material is restricted by the restriction member divided into a plurality of pieces in a longitudinal direction of the metal pipe material during forming.

DETAILED DESCRIPTION

Figure 1:
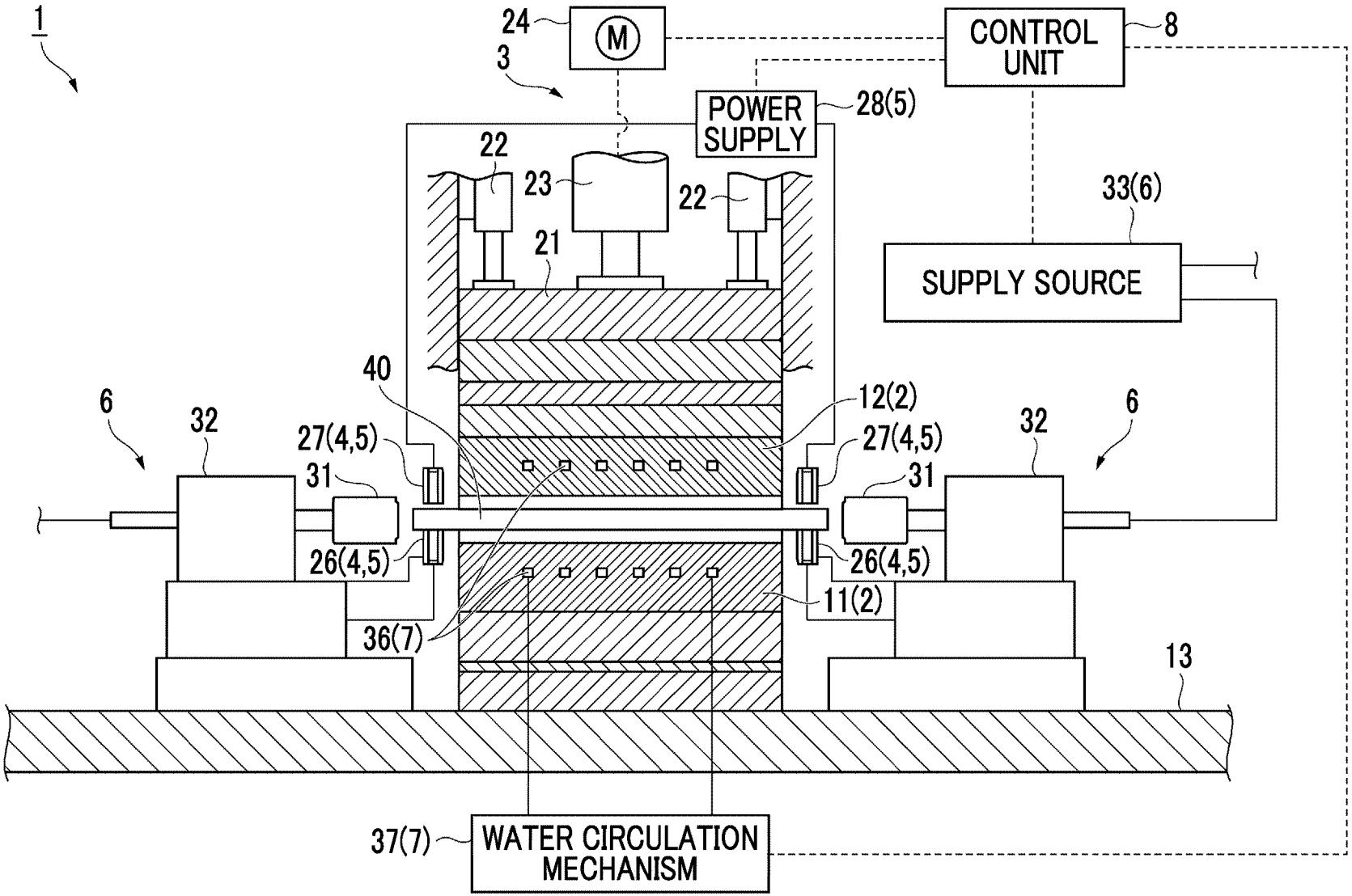
FIG. 1 is a schematic view of a forming device according to an embodiment of the present disclosure.

In the forming device such as the related art described above, there is a case where the metal pipe having a flange is formed by crushing both sides of the metal pipe material in a width direction with the upper die and the lower die. Meanwhile, the present inventors have recognized that it is difficult to form a flange portion to a desired size with such a forming device because when the flange portion is expanding in the width direction, the expansion cannot be restricted. On the other hand, a deviation of the metal pipe material can be restricted by providing a restriction member on a lateral side of the metal pipe material. However, an optimal restriction amount, a contact timing, and the like may be different depending on a position in a longitudinal direction of the metal pipe material. The present inventors have recognized that a variation occurs in a size of the flange portion of the metal pipe after forming in such a case.

It is desirable to provide a forming device and a forming method capable of reducing a variation in size of a flange portion of a metal pipe after forming.

The forming device includes the forming die that forms the metal pipe, and the restriction member that restricts the deviation of the metal pipe material during forming. Therefore, the forming die can perform forming while restricting the deviation of the metal pipe material with the restriction member. Here, the restriction member is divided into a plurality of pieces in the longitudinal direction of the metal pipe material during forming. Therefore, the divided restriction members can restrict the deviation at each position in the longitudinal direction with a restriction amount and a contact timing suitable for each position. From the above, it is possible to reduce a variation in size of a flange portion of the metal pipe after forming.

A plurality of the divided restriction members may be individually controlled. Accordingly, the divided restriction members are individually controlled such that a restriction amount and a contact timing suitable for each position are set at each position in the longitudinal direction.

The restriction member may restrict a deviation of the metal pipe material before forming. In this case, the restriction member can reduce the deviation of the metal pipe material in a stage before forming.

The restriction member may restrict a deviation of a planned flange portion that becomes a flange portion after completion. In this case, the restriction member can reduce a variation in size of the flange portion by restricting the deviation of the planned flange portion itself that becomes the flange portion.

According to the forming method, it is possible to obtain operations and effects having the same meaning as that of the above-described forming device.

Hereinafter, a preferred embodiment of the present disclosure will be described with reference to the drawings. In addition, in the respective drawings, the same portions or corresponding portions are designated by the same reference signs, and duplicated descriptions will not be repeated.

FIG. 1 is a schematic configuration view of a forming device 1 according to the present embodiment. As shown in FIG. 1, the forming device 1 is a device that forms a metal pipe having a hollow shape by blow forming. In the present embodiment, the forming device 1 is installed on a horizontal plane. The forming device 1 includes a forming tool (forming die) 2, a drive mechanism 3, a holding unit 4, a heating unit 5, a fluid supply unit 6, a cooling unit 7, and a control unit 8. In addition, in the present specification, a metal pipe material 40 (metal material) refers to a hollow article before completion of the forming by the forming device 1. The metal pipe material 40 is a steel-type pipe material that can be hardened. Additionally, in the horizontal direction, a direction in which the metal pipe material 40 extends during forming may be referred to as a "longitudinal direction", and a direction perpendicular to the longitudinal direction may be referred to as a "width direction".

The forming tool 2 is a die that forms a metal pipe 41 from the metal pipe material 40, and includes a lower die 11 and an upper die 12 that face each other in a vertical direction. The lower die 11 and the upper die 12 are made of steel blocks. Each of the lower die 11 and the upper die 12 is provided with a recessed part in which the metal pipe material 40 is accommodated. With the lower die 11 and the upper die 12 in close contact with each other (die closed state), respective recessed parts thereof form a space having a target shape in which the metal pipe material is to be formed. Therefore, a surface of each of the recessed parts serves as a forming surface of the forming tool 2. The lower die 11 is fixed to a base stage 13 via a die holder or the like. The upper die 12 is fixed to a slide of the drive mechanism 3 via a die holder or the like.

The drive mechanism 3 is a mechanism that moves at least one of the lower die 11 and the upper die 12. In FIG. 1, the drive mechanism 3 has a configuration in which only the upper die 12 is moved. The drive mechanism 3 includes a slide 21 that moves the upper die 12 such that the lower die 11 and the upper die 12 are joined together, and a pull-back cylinder 22 serving as an actuator that generates a force for pulling the slide 21 upward, a main cylinder 23 serving as a drive source that downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the longitudinal direction of the forming tool 2, and a lower electrode 26 and an upper electrode 27 that holds the metal pipe material 40 on the other end side in the longitudinal direction of the forming tool 2. The lower electrodes 26 and the upper electrodes 27 on both sides in the longitudinal direction hold the metal pipe material 40 by sandwiching vicinities of the end portions of the metal pipe material 40 from the vertical direction. In addition, groove portions having a shape corresponding to an outer peripheral surface of the metal pipe material 40 are formed on an upper surface of the lower electrode 26 and a lower surface of the upper electrode 27. The lower electrode 26 and the upper electrode 27 are provided with drive mechanisms (not shown) and are movable independently in the vertical direction.

The heating unit 5 heats the metal pipe material 40. The heating unit 5 is a mechanism that heats the metal pipe material 40 by energizing the metal pipe material 40. The heating unit 5 heats the metal pipe material 40 in a state in which the metal pipe material 40 is spaced apart from the lower die 11 and the upper die 12 between the lower die 11 and the upper die 12. The heating unit 5 includes the lower electrodes 26 and the upper electrodes 27 on both sides in the longitudinal direction as described above, and a power supply 28 that causes a current to flow through the metal pipe material 40 via the electrodes 26 and 27. In addition, the heating unit may be disposed in a preceding process of the forming device 1 and may perform heating externally.

The fluid supply unit 6 is a mechanism that supplies a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5 and expands the metal pipe material 40. The fluid supply unit 6 is provided on both end sides of the forming tool 2 in the longitudinal direction. The fluid supply unit 6 includes a nozzle 31 that supplies a fluid from an opening portion of an end portion of the metal pipe material 40 to the inside of the metal pipe material 40, a drive mechanism 32 that moves the nozzle 31 forward and backward with respect to the opening portion of the metal pipe material 40, and a supply source 33 that supplies the high-pressure fluid into the metal pipe material 40 via the nozzle 31. The drive mechanism 32 causes the nozzle 31 to be brought into close contact with the end portion of the metal pipe material 40 in a state in which sealing performance is secured during fluid supply and exhaust, and causes the nozzle 31 to be spaced apart from the end portion of the metal pipe material 40 at other times. In addition, the fluid supply unit 6 may supply a gas such as high-pressure air or an inert gas as the fluid. Additionally, the fluid supply unit 6 may include the heating unit 5 together with the holding unit 4 having a mechanism that moves the metal pipe material 40 in the vertical direction as the same device.

Figure 2A:
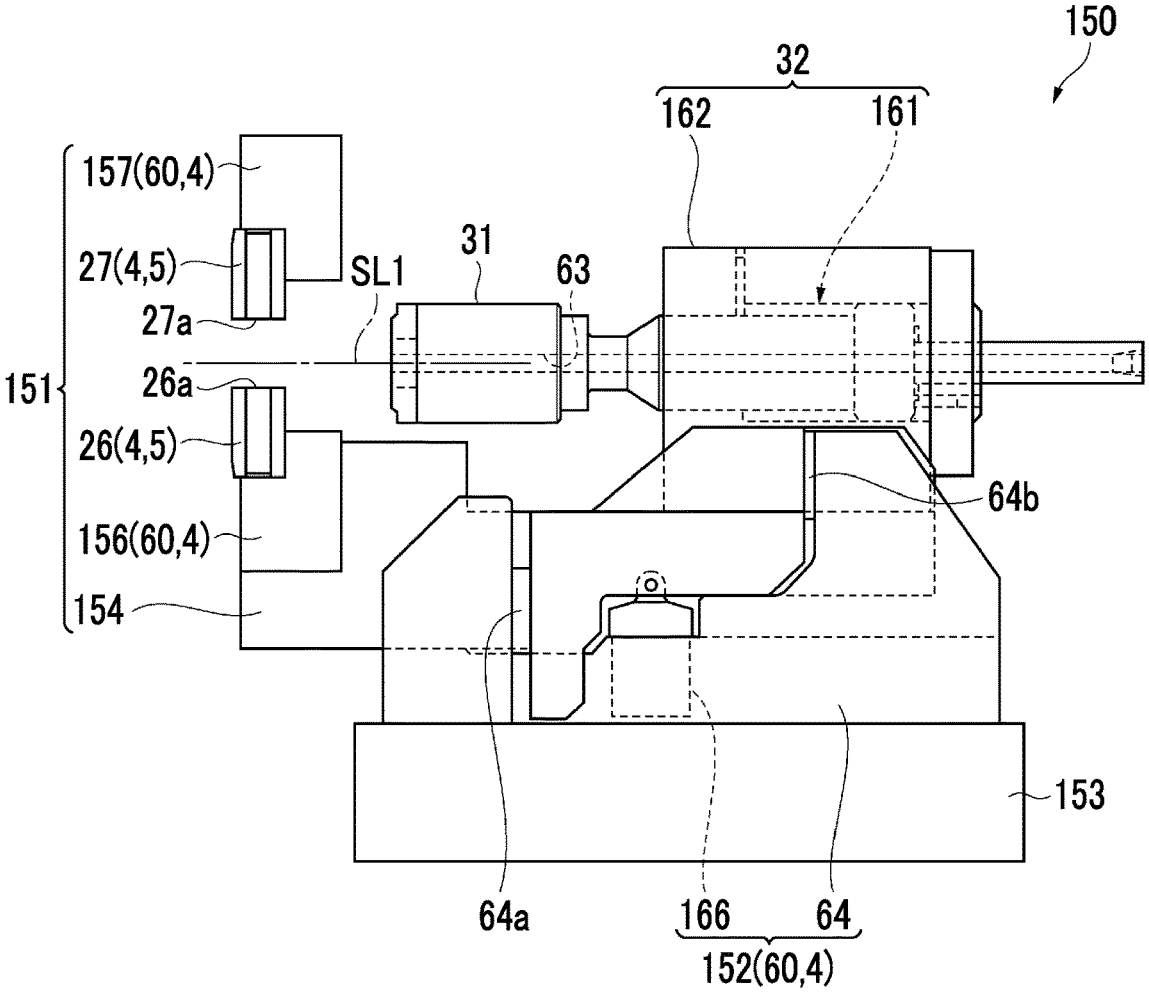
FIGS. 2A and 2B are cross-sectional views showing a state when a nozzle has sealed a metal pipe material.
Figure 2B:
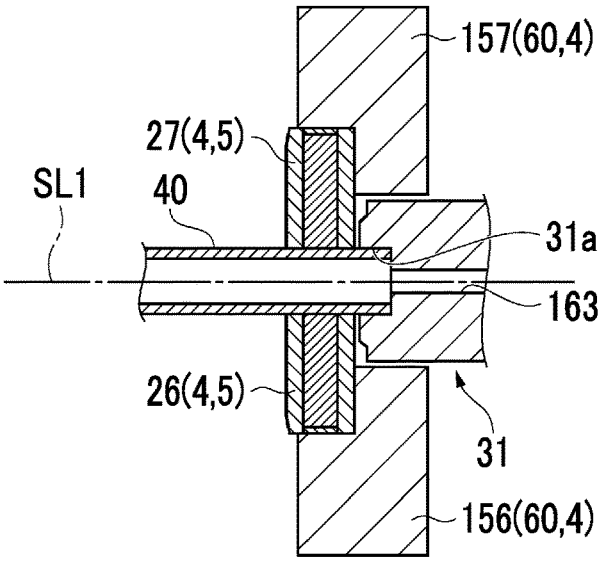

Components of the holding unit 4, the heating unit 5, and the fluid supply unit 6 may be configured as a unitized heating and expanding unit 150. FIG. 2A is a schematic side view showing the heating and expanding unit 150. FIG. 2B is a cross-sectional view showing a state when the nozzle 31 has sealed the metal pipe material 40.

As shown in FIG. 2A, the heating and expanding unit 150 includes the above-described lower electrode 26 and upper electrode 27, an electrode mounting unit 151 on which the electrodes 26 and 27 are mounted, the above-described nozzle 31 and drive mechanism 32, an elevating unit 152, and a unit base 153. The electrode mounting unit 151 includes an elevating frame 154 and electrode frames 156 and 157. The electrode frames 156 and 157 function as a part of a drive mechanism 60 that supports and moves each of the electrodes 26 and 27. The drive mechanism 32 drives the nozzle 31 and elevates the nozzle 31 together with the electrode mounting unit 151. The drive mechanism 32 includes a piston 161 that holds the nozzle 31, and a cylinder 162 that drives the piston. The elevating unit 152 includes an elevating frame base 64 attached to an upper surface of the unit base 153, and an elevating actuator 166 that applies an elevating operation to the elevating frame 154 of the electrode mounting unit 151 by the elevating frame base 64. The elevating frame base 64 includes guide portions 64*a* and 64*b* that guide the elevating operation of the elevating frame 154 with respect to the unit base 153. The elevating unit 152 functions as a part of the drive mechanism 60 of the holding unit 4. The heating and expanding unit 150 includes a plurality of the unit bases 153 of which upper surfaces have different inclination angles, and is allowed to collectively change and adjust inclination angles of the lower electrode 26 and the upper electrode 27, the nozzle 31, the electrode mounting unit 151, the drive mechanism 32, and the elevating unit 152 by replacing the unit bases 153.

The nozzle 31 is a cylindrical member into which the end portion of the metal pipe material 40 can be inserted. The nozzle 31 is supported by the drive mechanism 32 such that a center line of the nozzle 31 coincides with a reference line SL1. An inner diameter of a feed port 31*a* at an end portion of the nozzle 31 on the side of the metal pipe material 40 substantially coincides with an outer diameter of the metal pipe material 40 after expansion forming. In this state, the nozzle 31 supplies the high-pressure fluid from an internal flow path 163 to the metal pipe material 40. Examples of the high-pressure fluid include a gas and the like.

Returning to FIG. 1, the cooling unit 7 is a mechanism for cooling the forming tool 2. By cooling the forming tool 2, the cooling unit 7 can rapidly cool the metal pipe material 40 when the expanded metal pipe material 40 has come into contact with the forming surface of the forming tool 2. The cooling unit 7 includes a flow path 36 formed inside the lower die 11 and the upper die 12, and a water circulation mechanism 37 that supplies cooling water to the flow path 36 and circulates the cooling water.

The control unit 8 is a device that controls the entire forming device 1. The control unit 8 controls the drive mechanism 3, the holding unit 4, the heating unit 5, the fluid supply unit 6, and the cooling unit 7. The control unit 8 repeatedly performs an operation of forming the metal pipe material 40 with the forming tool 2.

Specifically, the control unit 8 controls, for example, a transport timing from a transport device such as a robot arm to dispose the metal pipe material 40 between the lower die 11 and the upper die 12 in an open state. Alternatively, a worker may manually dispose the metal pipe material 40 between the lower die 11 and the upper die 12. Additionally, the control unit 8 controls an actuator of the holding unit 4 and the like such that the metal pipe material 40 is supported by the lower electrodes 26 on both sides in the longitudinal direction, and then the upper electrodes 27 are lowered to sandwich the metal pipe material 40. Additionally, the control unit 8 controls the heating unit 5 to energize and heat the metal pipe material 40. Accordingly, an axial current flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and bring the upper die 12 close to the lower die 11 to close the forming tool 2. On the other hand, the control unit 8 controls the fluid supply unit 6 to seal the opening portions of both ends of the metal pipe material 40 with the nozzle 31 and supply the fluid. Accordingly, the metal pipe material 40 softened by heating expands and comes into contact with the forming surface of the forming tool 2. Then, the metal pipe material 40 is formed so as to follow a shape of the forming surface of the forming tool 2. In addition, in a case where a metal pipe with a flange is formed, a part of the metal pipe material 40 is made to enter a gap between the lower die 11 and the upper die 12, and then die closing is further performed to crush the entering part to form a flange portion. When the metal pipe material 40 comes into contact with the forming surface, quenching of the metal pipe material 40 is performed by being rapidly cooled with the forming tool 2 cooled by the cooling unit 7.

Figure 6:
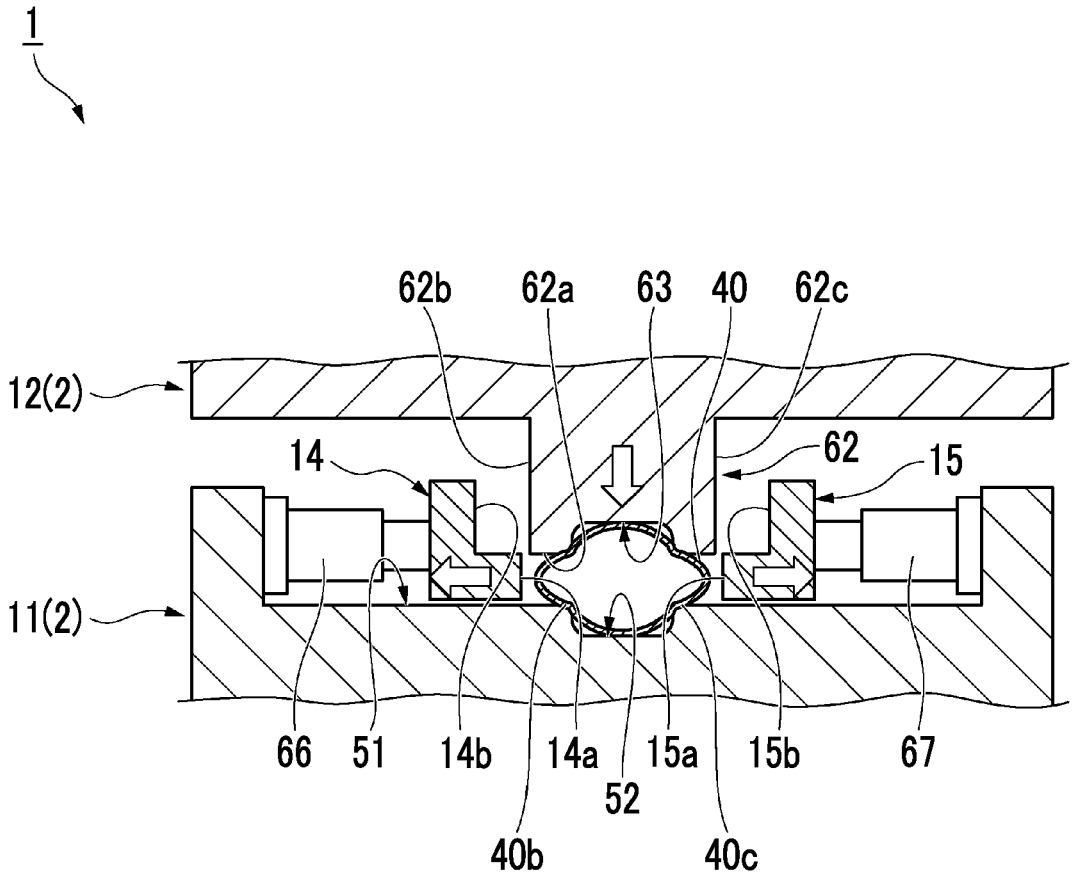
FIG. 6 is a cross-sectional view showing a state of forming by the forming tool.

The detailed configuration of the forming device 1 will be described with reference to FIGS. 3 and 4. First, the metal pipe 41 formed by the forming tool 2 will be described with reference to FIG. 7. The metal pipe 41 includes a hollow pipe portion 41*a* and flange portions 41*b* and 41*c* protruding to both sides in the width direction. The pipe portion 41*a* has a rectangular tubular shape. However, a shape of the pipe portion 41*a* is not particularly limited and may be any shape depending on applications. The flange portions 41*b* and 41*c* are formed by crushing both end portions of the metal pipe material 40 in the width direction with the dies 11 and 12. In the metal pipe material 40, locations that are planned to become the flange portions 41*b* and 41*c* after completion are referred to as planned flange portions 40*b* and 40*c* (FIG. 6). Also in the following description, unless otherwise specified, a protrusion portion in the metal pipe 41 after completion of forming is referred to as a "flange portion". Further, in the metal pipe material 40 in a state before the completion of forming, a location planned to become the flange portion after the completion is referred to as a "planned flange portion". A shape of the "planned flange portion" changes depending on a degree of progress of forming. As shown in FIG. 4, the metal pipe material 40 (and the metal pipe 41) is curved so as to protrude to one side in the width direction when viewed from the vertical direction.

The shape of the metal pipe material 40 is not particularly limited and is not limited to a shape curved at one location. For example, the metal pipe material 40 may have a complex shape that is curved at a plurality of locations, or may have a linear shape.

Figure 3:
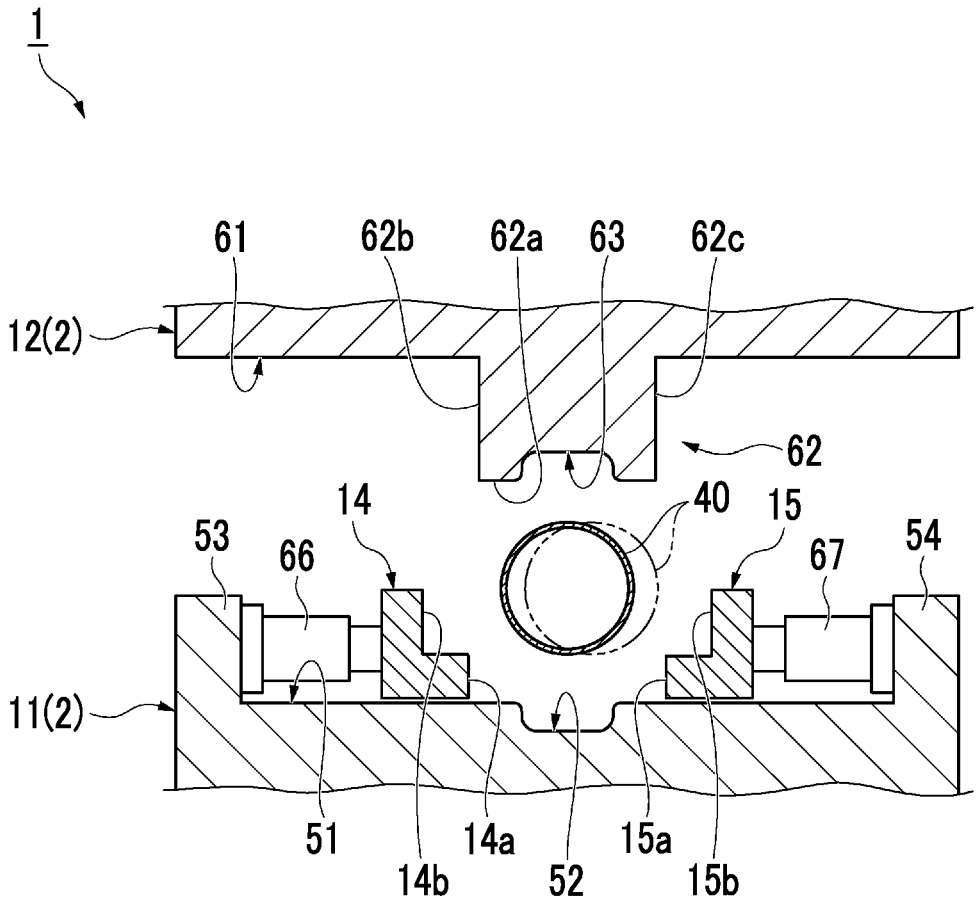
FIG. 3 is a cross-sectional view showing a state of forming by a forming tool.
Figure 4:
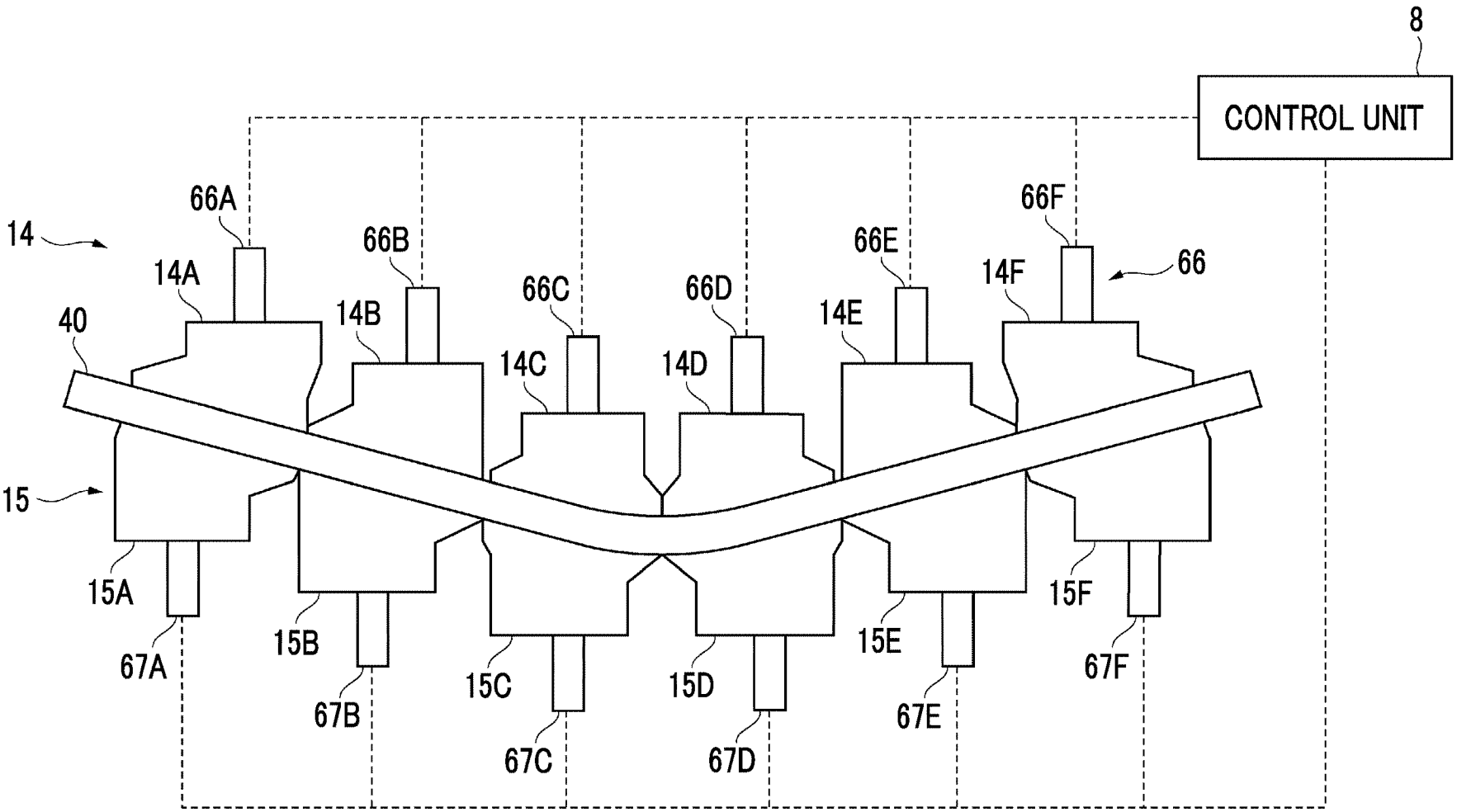
FIG. 4 is a schematic configuration view showing a configuration of a divided restriction member.

As shown in FIG. 3, the lower die 11 includes a planar portion 51 expanding in the width direction, a recessed part 52 formed at a central position of the planar portion 51 in the width direction, and support portions 53 and 54 formed at both outer end portions in the width direction. The recessed part 52 is a portion that forms a lower portion of the pipe portion 41*a* of the metal pipe 41 (refer to FIG. 7). In the planar portion 51, both sides of the recessed part 52 in the width direction are configured as forming surfaces for forming the flange portions 41*b* and 41*c* (refer to FIG. 7). The support portions 53 and 54 are portions that protrude upward from the planar portion 51. The support portion 53 is a portion that supports a restriction member 14 on a lateral side, and the support portion 54 is a portion that supports a restriction member 15 on a lateral side.

The upper die 12 includes a planar portion 61 expanding in the width direction and a forming body portion 62 protruding downward at a central position of the planar portion 61 in the width direction. The forming body portion 62 has a substantially rectangular cross-sectional shape extending downward from the planar portion 61. The forming body portion 62 includes a recessed part 63 on a lower surface 62*a*. The recessed part 63 is a portion that forms an upper portion of the pipe portion 41*a* of the metal pipe 41 (refer to FIG. 7). The lower surface 62*a* of the forming body portion 62 is configured as a forming surface for forming the flange portions 41*b* and 41*c* on both sides of the recessed part 63 in the width direction (refer to FIG. 7). The forming body portion 62 has side surfaces 62*b* and 62*c* on both sides in the width direction.

The restriction member 14 on a lateral side is disposed on one side of the metal pipe material 40 in the width direction. The restriction member 15 on a lateral side is disposed on the other side of the metal pipe material 40 in the width direction. The restriction members 14 and 15 are members that restrict a deviation of the metal pipe material 40 during forming. The restriction members 14 and 15 restrict a deviation of the metal pipe material 40 in the width direction such that the deviation does not become equal to or larger than a predetermined amount and is within a certain range. The restriction members 14 and 15 have restriction surfaces 14*a* and 15*a* that restrict the deviation of the metal pipe material 40, on inner sides in the width direction. Side surfaces 14*b* and 15*b* disposed at positions outside the restriction surfaces 14*a* and 15*a* in the width direction are formed on upper sides of the restriction surfaces 14*a* and 15*a*.

The restriction member 14 is connected to a drive mechanism 66 provided in the support portion 53 of the die 11. The drive mechanism 66 extends inward in the width direction from the support portion 53 and is connected to the restriction member 14. The restriction member 15 is connected to a drive mechanism 67 provided in the support portion 54 of the die 11. The drive mechanism 67 extends inward in the width direction from the support portion 54 and is connected to the restriction member 15. The drive mechanisms 66 and 67 are mechanisms that apply a driving force for causing the restriction members 14 and 15 to reciprocate in the width direction. A driving method of the drive mechanisms 66 and 67 is not particularly limited. A hydraulic driving system may be adopted, or a driving system such as a servo motor may be adopted.

As shown in FIG. 4, the restriction member 14 is divided into a plurality of pieces in the longitudinal direction of the metal pipe material 40 during forming. The plurality of divided restriction members 14 are provided with individual drive mechanisms 66. In the example shown in FIG. 4, the restriction member 14 is divided into six restriction members 14A to 14F. In addition, drive mechanisms 66A to 66F are individually provided for each of the restriction members 14A to 14F. The restriction member 15 is divided into a plurality of pieces in the longitudinal direction of the metal pipe material 40 during forming. The plurality of divided restriction members 15 are provided with individual drive mechanisms 67. In the example shown in FIG. 4, the restriction member 15 is divided into six restriction members 15A to 15F. In addition, drive mechanisms 67A to 67F are individually provided for each of the restriction members 15A to 15F.

The plurality of divided restriction members 14A to 14F and 15A to 15F are individually controlled. That is, the control unit 8 transmits an individual control signal to each of the drive mechanisms 66A to 66F and 67A to 67F provided in the plurality of restriction members 14A to 14F and 15A to 15F. The control unit 8 operates the drive mechanisms 66A to 66F and 67A to 67F by various control systems such as position control, pressure control, or time control. In this manner, the control unit 8 can individually control the restriction members 14A to 14F and 15A to 15F to be disposed at any desired timing and any desired position at each position in the longitudinal direction of the metal pipe material 40. In this manner, the control unit 8 can control the restriction members 14A to 14F and 15A to 15F in accordance with an optimal restriction amount, an optimal contact timing, and the like, depending on the position in the longitudinal direction of the metal pipe material 40.

Next, a procedure of forming by the forming device 1 will be described with reference to FIGS. 3 and 5 to 7. In the present embodiment, the restriction members 14 and 15 are disposed to restrict the deviation of the metal pipe material 40 before forming (here, before expansion). The restriction members 14 and 15 are disposed at positions symmetrical to each other with respect to a central position of the forming tool 2 in the width direction at each timing. Accordingly, the restriction surfaces 14*a* and 15*a* of the restriction members 14 and 15 on inner sides in the width direction are disposed at equal distances from the central position of the forming tool 2 in the width direction.

Figure 5:
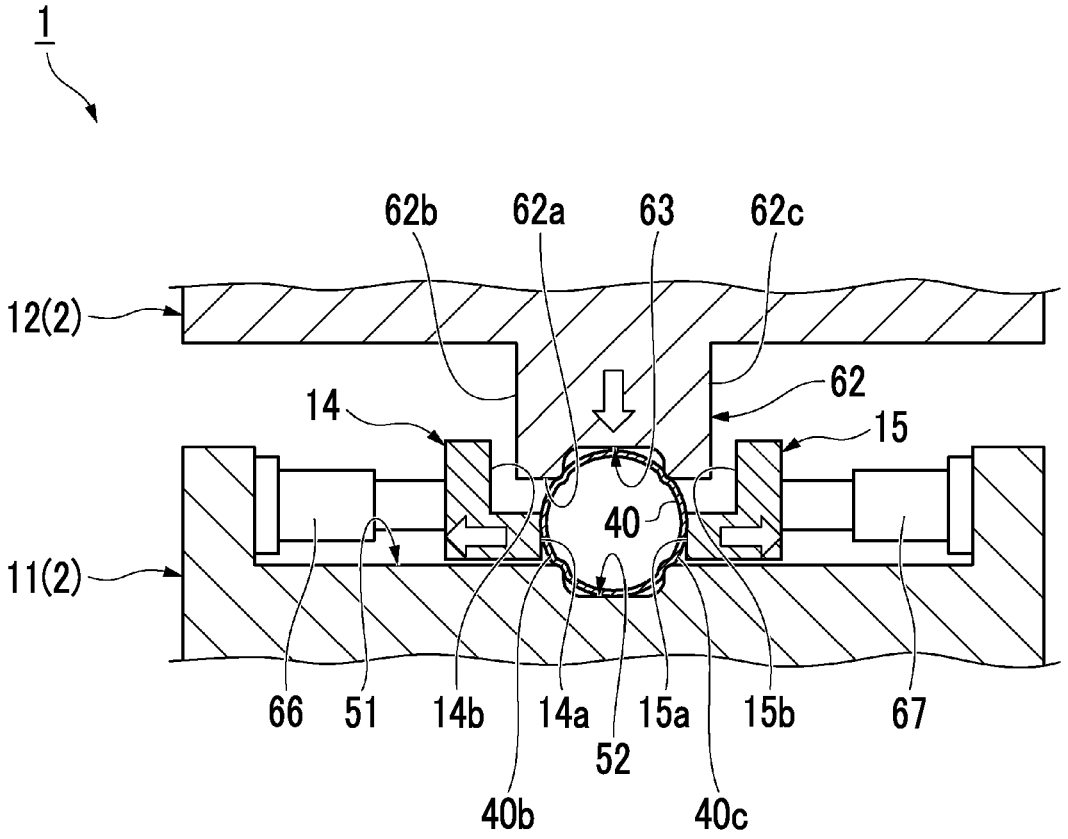
FIG. 5 is a cross-sectional view showing a state of forming by the forming tool.

First, as shown in FIG. 3, in an initial state of forming, the dies 11 and 12 and the restriction members 14 and 15 are disposed at positions separated from the metal pipe material 40. The control unit 8 heats the metal pipe material 40 in this state. Accordingly, it is possible to prevent the restriction members 14 and 15 from coming into contact with the metal pipe material 40 due to an influence of thermal expansion or Lorentz force, and to prevent electrical leakage due to such contact. Next, as shown in FIG. 5, the control unit 8 lowers the die 12 downward. In addition, the control unit 8 controls the drive mechanisms 66 and 67 to move the restriction members 14 and 15 inward in the width direction such that the restriction surfaces 14*a* and 15*a* are disposed at predetermined restriction positions. For example, a case where the metal pipe material 40 is disposed to be deviated in the width direction from a central position in the initial state of forming is considered (refer to an imaginary line in FIG. 3). In this case, the restriction surface 15*a* of the restriction member 15 is brought into contact with the metal pipe material 40 and is pressed to the central position, so that the deviation of the metal pipe material 40 is restricted.

In addition, as shown in FIG. 5, the control unit 8 controls the fluid supply unit 6 to supply the fluid into the metal pipe material 40 to perform blow forming (primary blowing). The portions of the planned flange portions 40*b* and 40*c* on both sides of the metal pipe material 40 in the width direction expand so as to enter between the planar portion 51 of the die 11 and the lower surface 62*a* of the die 12. The control unit 8 may move the restriction members 14 and 15 outward in the width direction in accordance with the expansion of the planned flange portions 40*b* and 40*c*. In this case, the control unit 8 may move the restriction members 14 and 15 outward in the width direction while in contact with the planned flange portions 40*b* and 40*c* with the restriction surfaces 14*a* and 15*a*, thereby moving the restriction members 14 and 15 while correcting the deviation of the planned flange portions 40*b* and 40*c*.

Next, as shown in FIG. 6, the control unit 8 further lowers the die 12 downward. The planned flange portions 40*b* and 40*c* of the metal pipe material 40 are further crushed between the planar portion 51 of the die 11 and the lower surface 62*a* of the die 12, so that dimensions thereof in the width direction gradually increase with lowering of the die 12. The control unit 8 may further move the restriction members 14 and 15 outward in the width direction. In this case, the control unit 8 may move the restriction members 14 and 15 to control protruding forces of the planned flange portions 40*b* and 40*c* with the restriction surfaces 14*a* and 15*a*. In this case, even when the planned flange portions 40*b* and 40*c* try to largely protrude outward in the width direction due to variations, the planned flange portions 40*b* and 40*c* are restricted by the restriction surfaces 14*a* and 15*a* of the restriction members 14 and 15 and do not become larger than that.

Figure 7:
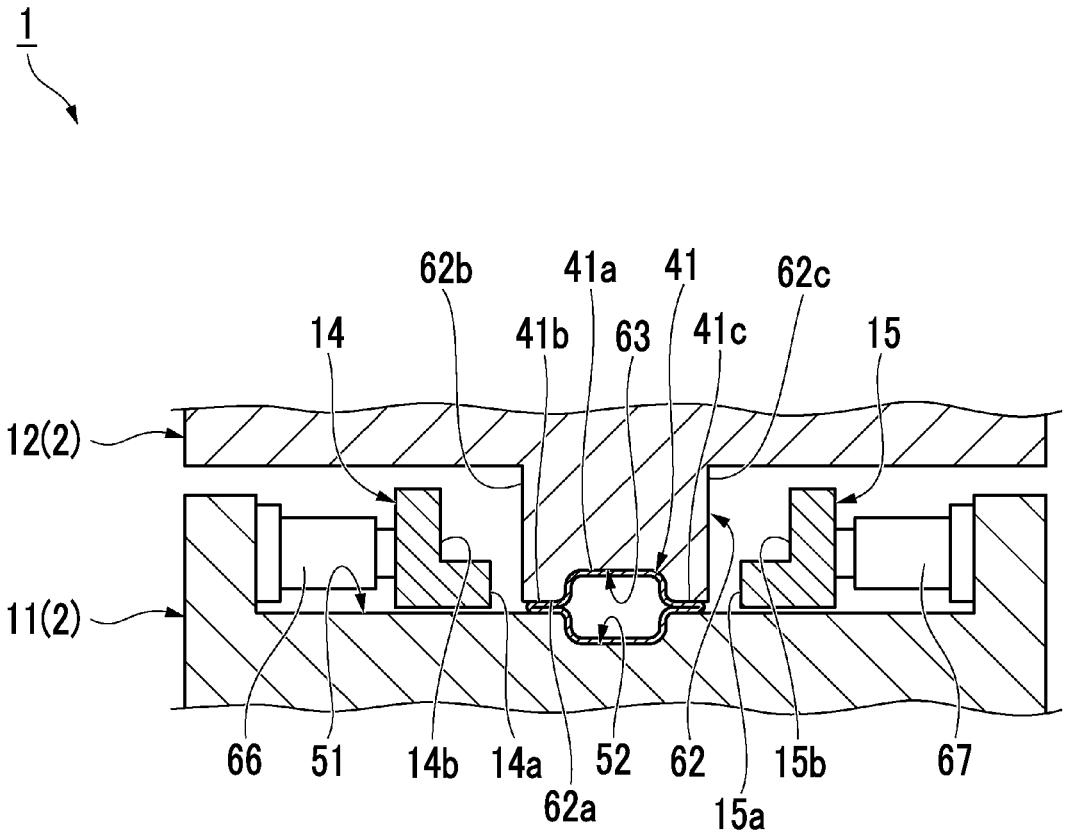
FIG. 7 is a cross-sectional view showing a state of forming by the forming tool.

The control unit 8 further lowers the die 12 downward so that the dies 11 and 12 are completely closed as shown in FIG. 7 (bottom dead center). In this case, the planned flange portions 40*b* and 40*c* are completely crushed to form the completed flange portions 41*b* and 41*c*. In this state, the control unit 8 supplies the fluid to the metal pipe material 40 by the fluid supply unit 6. Accordingly, the forming device 1 completes the metal pipe 41 by forming the pipe portion 41*a* corresponding to the shape of the recessed parts 52 and 63 (secondary blowing). After this, the control unit 8 moves the die 12 upward to open the die.

Next, operations and effects of the forming device 1 according to the present embodiment will be described.

The forming device 1 includes the forming tool 2 that forms the metal pipe 41, and the restriction members 14 and 15 that restrict the deviation of the metal pipe material 40 during forming. Therefore, the forming tool 2 can perform forming while restricting the deviation of the metal pipe material 40 with the restriction members 14 and 15. Here, the restriction members 14 and 15 are divided into a plurality of pieces in the longitudinal direction of the metal pipe material 40 during forming. Therefore, the divided restriction members 14A to 14F and 15A to 15F can restrict the deviation at each position in the longitudinal direction with a restriction amount and a contact timing suitable for each position. From the above, it is possible to reduce variations in size of the flange portions 41*b* and 41*c* of the metal pipe 41 after forming.

In particular, in a case of the curved metal pipe material 40 shown in FIG. 4, a curvature may be different, or a distribution of heat due to energization heating may be different, depending on the position in the longitudinal direction. Therefore, an appropriate restriction amount is different depending on the position in the longitudinal direction of the metal pipe material 40. Therefore, the restriction members 14A to 14F and 15A to 15F can restrict the deviation in an appropriate mode according to each position of the curved shape.

The plurality of divided restriction members 14A to 14F and 15A to 15F may be individually controlled. Accordingly, the divided restriction members 14A to 14F and 15A to 15F are individually controlled such that a restriction amount and a contact timing suitable for each position are set at each position in the longitudinal direction.

The restriction members 14 and 15 may restrict the deviation of the metal pipe material 40 before forming. In this case, the restriction members 14 and 15 can reduce the deviation of the metal pipe material 40 in a stage before forming.

A forming method is a forming method of forming the metal pipe 41 with a flange from the metal pipe material 40, and includes a step of restricting the deviation of the metal pipe material 40 with the restriction members 14 and 15 during forming of the metal pipe 41, and in this step, the deviation of the metal pipe material 40 is restricted by the restriction members 14A to 14F and 15A to 15F divided into a plurality of pieces in the longitudinal direction of the metal pipe material 40 during the forming.

According to this forming method, it is possible to obtain operations and effects having the same meaning as that of the above-described forming device 1.

The present disclosure is not limited to the above-described embodiment.

In the above-described embodiment, the restriction members 14 and 15 restrict the deviation of the metal pipe material 40 before the forming. However, instead of this, the restriction members 14 and 15 may restrict the deviation of the planned flange portions 40*b* and 40*c* that become the flange portions 41*b* and 41*c* after completion. In this case, the restriction members 14 and 15 can reduce variations in size of the flange portions 41*b* and 41*c* by restricting the deviation of the planned flange portions 40*b* and 40*c* themselves that become the flange portions 41*b* and 41*c*.

Figure 8A:
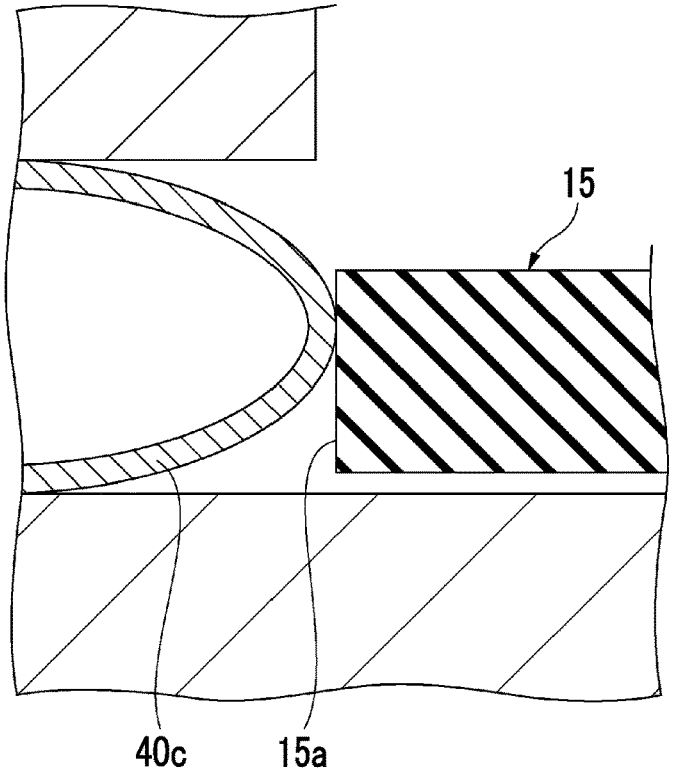
FIGS. 8A and 8B are enlarged cross-sectional views showing a state where a restriction member restricts a planned flange portion.
Figure 8B:
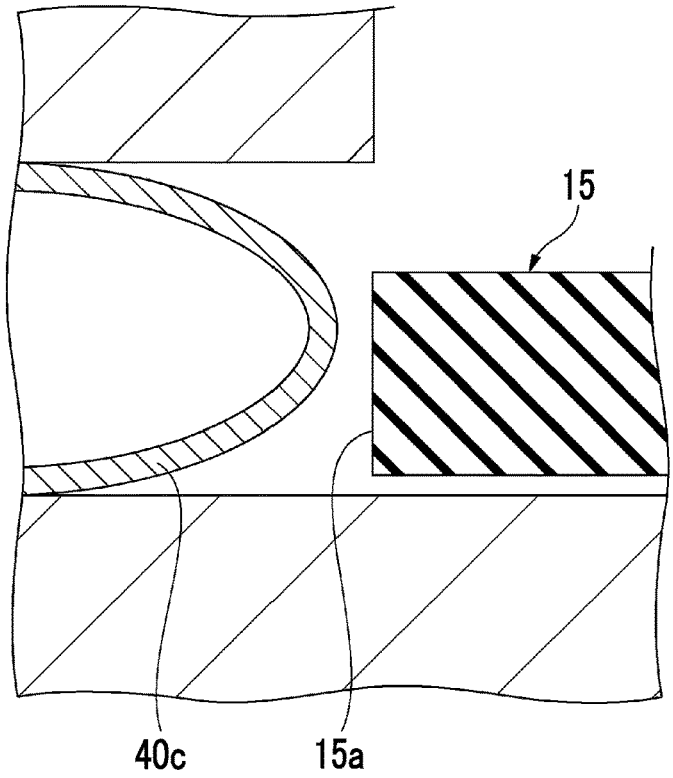

For example, as shown in FIG. 8A, in a case where, for example, the metal pipe material 40 deviates to the restriction member 15 side so that the protrusion amount of the planned flange portion 40*c* increases, the restriction member 15 may bring the restriction surface 15*a* into contact with the planned flange portion 40*c* to suppress the protrusion of the planned flange portion 40*c*. Accordingly, it is possible to prevent the flange portions 41*b* and 41*c* from becoming too large. On the other hand, as shown in FIG. 8B, when the protrusion amount of the planned flange portion 40*c* is as planned or shorter than planned, the restriction member 15 retreats so as not to come into contact with the planned flange portion 40*c* so that the restriction member 15 does not hinder the protrusion of the planned flange portion 40*c*.

In the above-described embodiment, the restriction members are provided on both sides in the width direction. However, the restriction member may be provided on only one side in the width direction.

In the above-described embodiment, the description has been made by using the forming tool adopted in the forming device for STAF as an example. However, the type of the forming device in which the forming tool according to the present disclosure is adopted is not particularly limited, and may be any type of the forming device that supplies a fluid to expand the metal pipe material.

Aspect 1

A forming device that forms a metal pipe with a flange from a metal pipe material, the forming device including:

a forming die that forms the metal pipe; and a restriction member that restricts a deviation of the metal pipe material during forming, in which the restriction member is divided into a plurality of pieces in a longitudinal direction of the metal pipe material during forming.

Aspect 2

The forming device according to Aspect 1, in which a plurality of the divided restriction members may be individually controlled.

Aspect 3

The forming device according to Aspect 1, in which the restriction member may restrict a deviation of the metal pipe material before forming.

Aspect 4

The forming device according to Aspect 1, in which the restriction member may restrict a deviation of a planned flange portion that becomes a flange portion after completion.

Aspect 5

A forming method of forming a metal pipe with a flange from a metal pipe material, the forming method including:

a step of restricting a deviation of the metal pipe material with a restriction member during forming of the metal pipe, in which in the step, the deviation of the metal pipe material is restricted by the restriction member divided into a plurality of pieces in a longitudinal direction of the metal pipe material during forming.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe with a flange from a metal pipe material, the forming device comprising:

a forming die that forms the metal pipe; and a restriction member that restricts a deviation of the metal pipe material during forming by contacting an outer circumferential surface of the metal pipe, wherein the restriction member is divided into a plurality of pieces in a longitudinal direction of the metal pipe material during forming; wherein a plurality of the divided restriction members are individually controlled.

2. The forming device according to claim 1, wherein the restriction member restricts a deviation of the metal pipe material before forming.

3. The forming device according to claim 2, wherein a plurality of the restriction members are disposed at positions symmetrical to each other with respect to a central position of the forming die in a width direction.

4. The forming device according to claim 3, wherein the plurality of restriction members have restriction surfaces that restrict the deviation of the metal pipe material, on inner sides in the width direction, and the restriction surfaces are disposed at equal distances from the central position of the forming die in the width direction.

5. The forming device according to claim 1, wherein the restriction member restricts a deviation of a planned flange portion that becomes a flange portion after completion.

6. The forming device according to claim 1, wherein the forming die includes a lower die and an upper die that face each other in a vertical direction, and each of the lower die and the upper die is provided with a recessed part in which the metal pipe material is accommodated.

7. The forming device according to claim 6, wherein the lower die is fixed to a base stage via a die holder, and the upper die is fixed to a slide of a drive mechanism via a die holder.

8. The forming device according to claim 7, wherein the slide of the drive mechanism moves the upper die such that the lower die and the upper die are joined together.

9. The forming device according to claim 6, wherein the lower die includes a planar portion, and the recessed part is formed at a central position of the planar portion in a width direction.

10. The forming device according to claim 9, wherein the lower die includes a first support portion and a second support portion formed at both outer end portions in the width direction, and the first support portion and the second support portion are portions that protrude upward from the planar portion.

11. The forming device according to claim 10, wherein the first support portion and the second support portion are portions that support the restriction member on a lateral side.

12. The forming device according to claim 6, wherein the upper die includes a planar portion and a forming body portion protruding downward at a central position of the planar portion in a width direction, and the forming body portion is provided with the recessed part on a lower surface.

13. The forming device according to claim 12, wherein the lower surface of the forming body portion is configured as a forming surface for forming flange portions on both sides of the recessed part in the width direction.

* * * * *